US008943869B2

(12) United States Patent
Li et al.

(10) Patent No.: US 8,943,869 B2
(45) Date of Patent: Feb. 3, 2015

(54) MULTIPLE CLAMP TYPE STRETCHING AND FORMING MACHINE

(75) Inventors: Mingzhe Li, Changchun (CN); Qigang Han, Changchun (CN); Wenzhi Fu, Changchun (CN); Pengxiao Feng, Changchun (CN); Yushan Deng, Changchun (CN); Zhongyi Cai, Changchun (CN); Chunguo Liu, Changchun (CN); Zhen Sui, Changchun (CN)

(73) Assignee: Jilin University, Changchun (CN)

( * ) Notice: Subject to any disclaimer, the term of this patent is extended or adjusted under 35 U.S.C. 154(b) by 372 days.

(21) Appl. No.: 13/501,034

(22) PCT Filed: Oct. 8, 2010

(86) PCT No.: PCT/CN2010/077581

§ 371 (c)(1),
(2), (4) Date: Apr. 9, 2012

(87) PCT Pub. No.: WO2011/041984

PCT Pub. Date: Apr. 14, 2011

(65) Prior Publication Data

US 2012/0198904 A1 Aug. 9, 2012

(30) Foreign Application Priority Data

| | | |
|---|---|---|
| Oct. 9, 2009 | (CN) | 2009 1 0217701 |
| Aug. 28, 2010 | (CN) | 2010 1 0266441 |
| Sep. 7, 2010 | (CN) | 2010 1 0273822 |
| Sep. 7, 2010 | (CN) | 2010 1 0273846 |

(51) Int. Cl.

| | |
|---|---|
| ***B21D 11/02*** | (2006.01) |
| ***B21D 11/00*** | (2006.01) |
| ***B21D 25/04*** | (2006.01) |

(52) U.S. Cl.
CPC ..... *B21D 11/02* (2013.01); *B21D 25/04* (2013.01)
USPC ..... 72/296; 72/305

(58) Field of Classification Search
USPC ..... 72/295, 296, 297, 301, 302, 305, 311, 72/392
See application file for complete search history.

(56) References Cited

U.S. PATENT DOCUMENTS

| | | | | |
|---|---|---|---|---|
| 2,753,915 | A * | 7/1956 | Raynes | 72/305 |
| 3,299,688 | A * | 1/1967 | Gray | 72/296 |

(Continued)

FOREIGN PATENT DOCUMENTS

| | | |
|---|---|---|
| CN | 101214505 A | 7/2008 |
| CN | 201175749 Y | 1/2009 |

(Continued)

OTHER PUBLICATIONS

Xue et al., "Numerical Simulation of Multiple Grippers Flexible Stretch Forming for Spherical Part," Forming &Stamping Technology, vol. 35, No. 4, pp. 32-35 (2010).

(Continued)

*Primary Examiner* — Teresa M Ekiert
(74) *Attorney, Agent, or Firm* — Jenkins, Wilson, Taylor & Hunt, P.A.

(57) ABSTRACT

A multiple clamp type stretching and forming machine is composed of multiple material clamping mechanisms (1), multiple material stretching mechanisms (2) and a frame (3). The material clamping mechanism (1) is composed of a material clamping frame (7), material clamping blocks (8, 9) and a hydraulic cylinder (6) for clamping material. The two sides of the frame (3) are arranged with a row of multiple material clamping mechanisms (1), respectively. The material clamping frame (7) of each material clamping mechanism (1) is provided with one or two connecting holes (5), which connect with one or more material stretching mechanisms (2) through a universal push-pull mechanism (4). The stretching and forming machine can improve the utilization ratio of the material, and reduce the manufacturing cost.

13 Claims, 11 Drawing Sheets

(56) References Cited

U.S. PATENT DOCUMENTS

| | | | |
|---|---|---|---|
| 4,815,308 | A | 3/1989 | Moroney |
| 6,018,970 | A | 2/2000 | Ford et al. |

FOREIGN PATENT DOCUMENTS

| | | | |
|---|---|---|---|
| CN | 101596563 | A | 12/2009 |
| CN | 101690960 | A | 4/2010 |
| CN | 201455086 | U | 5/2010 |
| CN | 201603795 | U | 10/2010 |

OTHER PUBLICATIONS

International Search Report for Application Serial No. WO 2011/041984 dated Jan. 20, 2011.

* cited by examiner

MULTIPLE CLAMP TYPE STRETCHING AND FORMING MACHINE

TECHNICAL FIELD

The invention relates to a multi-clamp type stretch forming machine which is used in the mechanical engineering field for plastic processing of a sheet type workpiece to form a curved surface.

BACKGROUND ART

When a workpiece is processed in a stretch forming process with a traditional stretch forming machine, the stretching action is generally provided by means of only one or two hydraulic cylinders, and the sheet material of the workpiece is substantially integrally displaced in a transverse direction at the edge clamped by the clamps. When a workpiece having a relatively large transverse curvature is processed, the distribution of stretch stress and stretch strain in the transverse direction of the sheet material becomes obviously not uniform, which results in processing defects such as departure from mold, cracking and wrinkling. In order to avoid these defects, precision requirements to the forming machines are very high, and the control systems of them have generally complex designs, thus the forming machines are very expensive. In addition, the blank material for stretch forming has generally a relatively large non-processed margin area, which results in low material usage.

SUMMARY OF THE INVENTION

An object of the invention is to overcome the above mentioned defects by providing a multi-clamp type stretch forming machine having high flexibility. In the machine, by using Pascal law in multi-cylinder hydraulic systems, process hardening characteristics of materials and law of minimum resistance, flexible control of multi-clamps is achieved in a simple way. As a result, the workpiece is more liable to be affixed to its forming mold, and the workpiece may have significantly increased material usage and stretch forming quality. Further, compared with traditional stretch forming machines, the multi-clamp type stretch forming machine of the invention can provide more uniform distribution of stretch stress and stretch strain, so that workpiece with curved surfaces can be stretch formed more uniformly. Meanwhile, manufacturing cost of the stretch forming machines can be lowered down.

For this end, the invention provides a multi-clamp type stretch forming machine, mainly comprising clamping mechanisms, stretching mechanisms and a machine frame, each clamping mechanism comprising a clamping frame, a clamper and a hydraulic clamping cylinder, wherein a row of multiple clamping mechanisms are aligned on each of opposite sides of the machine frame, the clamping frame of each clamping mechanism is provided with one or two connecting holes, and each connecting hole is coupled with one or more stretching mechanisms by means of a universal push-pull mechanism.

Optionally, in the condition that the clamping frame is provided with one connecting hole, the connecting hole is a rear connecting hole which is coupled simultaneously with at least two stretching mechanisms by means of the universal push-pull mechanism, wherein the first stretching mechanism is disposed in a horizontal orientation, and the second stretching mechanism is selectively disposed in a vertical orientation or in an oblique orientation.

Optionally, in the condition that the clamping frame is provided with two connecting holes, the connecting holes comprise a rear connecting hole and a lower connecting hole, the lower connecting hole being coupled with a vertically disposed stretching mechanism by means of a universal push-pull mechanism, and the rear connecting hole being coupled, by means of another universal push-pull mechanism, with a horizontally disposed stretching mechanism, or coupled, by means of another universal push-pull mechanism, simultaneously with a set of stretching mechanisms which comprise any combination of a horizontally disposed stretching mechanism, an obliquely disposed stretching mechanism and a vertically disposed stretching mechanism.

Optionally, each stretching mechanism comprises a hydraulic stretching cylinder, and a row of hydraulic stretching cylinders aligned in the same direction are controlled by means of one or more solenoid type reversing valves.

Optionally, each universal push-pull mechanism mainly comprises a ball-headed linkage, or mainly comprises a pivot shaft, or mainly comprises a combination of a ball-headed linkage, a pivot shaft and a link; one end of the ball-headed linkage forms a ball-shaped head, the ball-shaped head being mounted in the clamping frame or in a stretching link, directly or by means of a bearing shoe having a half-ball-shaped recess which is fit with ball-shaped surface of a retention portion of the ball-shaped head; and the opposite end of the ball-headed linkage is coupled with a corresponding link by means of a screw type mechanism or a pivot shaft.

Optionally, the ball-shaped head has a half-ball shape or a complete-ball shape; in the condition that the ball-shaped head has a half-ball shape, an elastic pad, such as a polyurethane pad, is provided at the ball-shaped head; and in the condition that the ball-shaped head has a complete-ball shape, a thrust bearing shoe having a half-ball-shaped recess is provided at the ball-shaped head.

Optionally, the ball-headed linkage comprises two ball-headed linkages which are coupled with each other symmetrically by means of a bar-like link, and thus a universal push-pull mechanism having dual ball-shaped heads is formed.

Optionally, the length of the universal push-pull mechanism is adjustable by means of a length-adjustable bar-like link.

Optionally, the pivot shaft is a solid pivot shaft or a hollow pivot shaft; and in the condition of a hollow pivot shaft, one or more steel wires or flexible steel shafts are inserted through a row of hollow pivot shafts.

Optionally, all the pivot shafts, as a whole, are substituted by one or more steel wires or flexible steel shafts inserted through the clamping mechanisms.

Optionally, each clamping mechanism in a row of multiple clamping mechanisms disposed on either side of the machine frame comprises a pair of clampers, a gap is formed between neighboring clampers, each damper comprises a clamping surface, a front edge and two front corners of which are rounded with relatively large radii, and right and left edges of the clamping surface, which are adjacent to other clampers, are also be rounded.

Optionally, the clamping surface of the clamper is a horizontal surface; or the clamping surface has a back end slightly higher than its front end; or the clamping surface has a back end which is a horizontal surface and is slightly higher than the front end of the clamping surface; or the clamping surface has a middle portion which is slightly higher than its left and right ends which are adjacent to other clampers and tapered gradually.

Optionally, the clamper has a rectangular shape, a trapezoidal shape, or a six-sided shape which is composed of a rectangle and a trapezoid; and the length of the front side of the clamping surface is equal to or less than the length of the back side of the clamping surface.

Optionally, each clamper is a biting clamper which has a clamping surface formed with many biting protrusions or a sliding-through clamper which has a clamping surface formed with several drawing ribs; and the biting clampers and the sliding-through clamper can be used in a mixed manner in a row of multiple clamping mechanisms.

Optionally, the distance between the clamping mechanisms and the stretching mechanisms on the left side of the machine frame and the clamping mechanisms and the stretching mechanisms on the right side of the machine frame is adjustable; and/or a forming mold to be used with the stretch forming machine comprises a solid mold or a multi-point adjustable digitalized mold, the forming mold having a mold base which is movable upwards; and/or a pushing-down mechanism is mounted to an upper portion of the stretch forming machine.

According to the multi-clamp type stretch forming machine of the invention, the Pascal law in a multi-cylinder hydraulic system, process hardening characteristics of materials and law of minimum resistance are used in the invention, so that, under the same level of hydraulic force of a row of hydraulic cylinders, a plurality of clamping mechanisms can move and rotate to follow the curvature of a molding surface. In this way, the load applying pattern on the workpiece is optimized, and the stretch stress and the stretch strain in the workpiece are distributed more uniformly. The mold affixing ability of the workpiece is increased, the non-processed margin area of a stretch formed piece is decreased, and the material usage and the forming quality are increased. The multi-clamp type stretch forming machine provides flexible control to a plurality of clampers by using a simple and cost efficient hydraulic system, so that the workpiece forming effect is improved with respect to traditional stretch forming machines.

BRIEF DESCRIPTION OF THE DRAWINGS

The above and other features and advantages of the invention will be described in details with reference to some exemplary embodiments illustrated in the drawings, in which:

FIG. 1 includes a set of schematic views of a multi-clamp type stretch forming machine in which each clamping frame has a single connecting hole, wherein:

FIG. 1(*a*) is an isometric view;

FIG. 1(*b*) is a front view;

FIG. 1(*c*) is an enlarged sectional view of a clamping mechanism shown in FIGS. 1(*a*) and 1(*b*);

FIG. 1(*d*) is a front view of a universal push-pull mechanism, as used in the machine shown in FIGS. 1(*a*) and 1(*b*), comprising mainly a ball-headed linkage and two pivot shafts; and FIG. 1(*e*) is a sectional view of FIG. 1(*d*);

FIG. 2 includes a set of schematic views of a multi-clamp type stretch forming machine in which each clamping frame has two connecting holes, wherein:

FIG. 2(*a*) is a front view showing a rear connecting hole and a lower connecting hole of the clamping frame, each connecting hole being coupled with one or more corresponding stretching mechanisms by means of a universal push-pull mechanism comprising mainly a ball-headed linkage and two pivot shafts;

FIG. 2(*b*) is an enlarged sectional view of a clamping mechanism shown in FIG. 2(*a*);

FIG. 2(*c*) is a front view showing a rear connecting hole of the clamping frame coupled with one or more corresponding stretching mechanisms by means of a universal push-pull mechanism comprising mainly a ball-headed linkage and two pivot shafts and a lower connecting hole of the clamping frame coupled with one or more corresponding stretching mechanisms by means of a universal push-pull mechanism comprising a pivot shaft;

FIG. 2(*d*) is a front view showing a rear connecting hole and a lower connecting hole of the clamping frame, each connecting hole being coupled with one or more corresponding stretching mechanisms by means of a universal push-pull mechanism comprising mainly a ball-headed linkage and a pivot shaft; and FIG. 2(*e*) is an enlarged sectional view of a clamping mechanism shown in FIG. 2(*d*);

FIG. 3 includes a set of sectional views of a ball-headed linkage, having a half-ball-shaped head at one end, mounted in a connecting hole of the clamping frame, wherein:

FIG. 3(*a*) is a sectional view of a ball-headed linkage, having a half-ball-shaped head at one end, mounted directly in a connecting hole of the clamping frame;

FIG. 3(*b*) is a sectional view of a ball-headed linkage, having a half-ball-shaped head at one end, mounted in a connecting hole of the clamping frame by means of a bearing shoe having a half-ball-shaped recess; and FIG. 3(*c*) is a sectional view of a ball-headed linkage, having a half-ball-shaped head at one end, mounted in a connecting hole of the clamping frame by means of a bearing shoe having a half-ball-shaped recess and a head retaining ring;

FIG. 7 includes a set of sectional views showing clamping frames and stretching mechanisms coupled by means of universal push-pull mechanisms which comprise different combinations of pivot shafts, a steel wire, a flexible steel shaft or the like, wherein:

FIG. 7(*a*) is a sectional view showing an embodiment in which stretching links and hydraulic cylinder type links are coupled by means of a plurality of hollow pivot shafts through which a steel wire or flexible steel shaft is inserted;

FIG. 7(*b*) is a sectional view showing an embodiment in which stretching links and hydraulic cylinder type links are coupled by means of a plurality of solid pivot shafts, and clamping frames and clamping linkages are coupled by means of a plurality of hollow pivot shafts through which a steel wire or flexible steel shaft is inserted;

FIG. 7(*c*) is a sectional view showing an embodiment in which stretching links and hydraulic cylinder type links are coupled and clamping frames and clamping linkages are coupled respectively by means of a plurality of hollow pivot shaft through which a steel wire or flexible steel shaft is inserted; and FIG. 7(*d*) is a sectional view showing an embodiment in which stretching links and hydraulic cylinder type links are coupled and clamping frames and clamping linkages are coupled respectively by means of a steel wire or flexible steel shaft directly;

FIG. 9 includes a set of schematic views of clampers with slanted clamping surfaces, wherein:

FIG. 9(*a*) is a schematic view of a clamper having a height gradually reduced from its back end to its front end; and FIG. 9(*b*) is a schematic view of a clamper having, from its back end to its front end, a horizontal segment and a tapered segment;

FIG. 10 includes a set of schematic views of clampers of different shapes, wherein:

FIG. 10(*a*) is a schematic view of a rectangular clamper;

FIG. 10(*b*) is a schematic view of a trapezoidal clamper; and

FIG. 10(*c*) is a schematic view of a six-sided clamper having a profile formed by combination of a rectangle and a trapezoid;

LIST OF REFERENCE NUMERALS

Figure 1A:
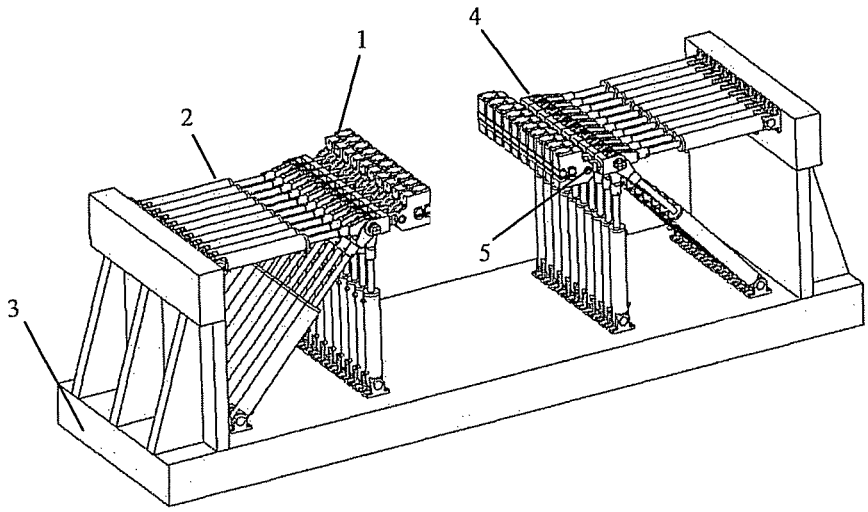
Figure 1B:
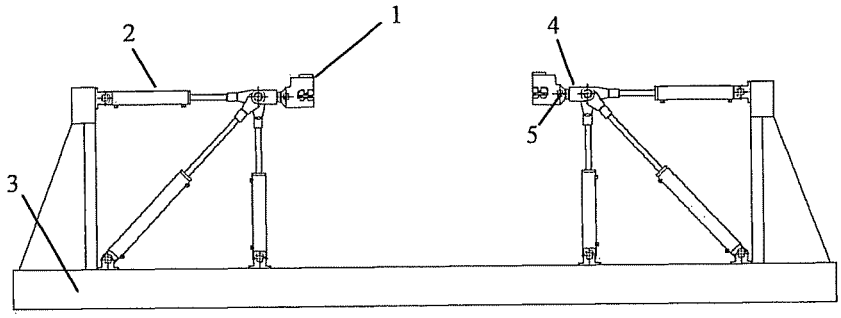
Figure 1C:
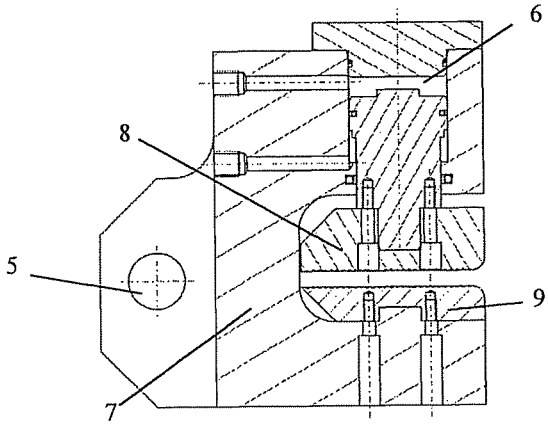
Figure 1D:
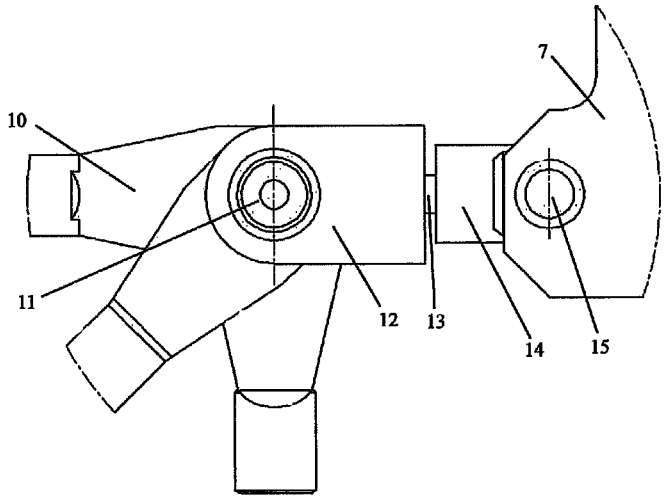
Figure 1E:
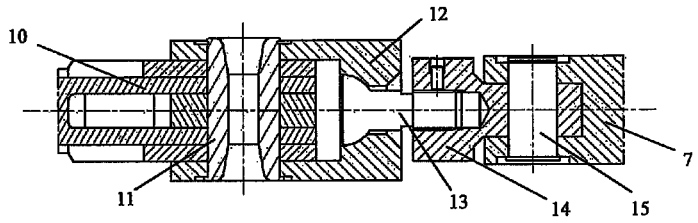
Figure 2A:
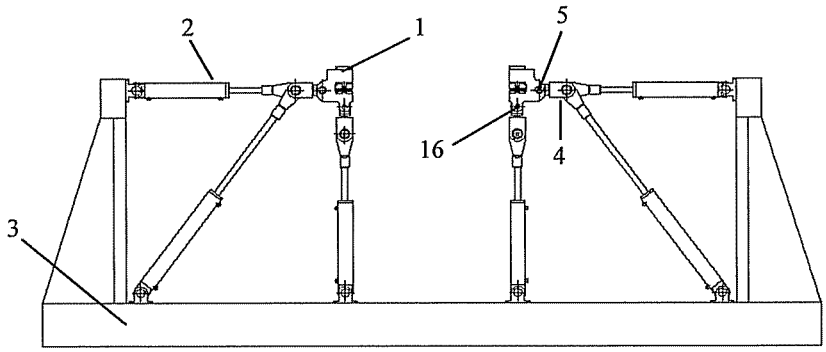
Figure 2B:
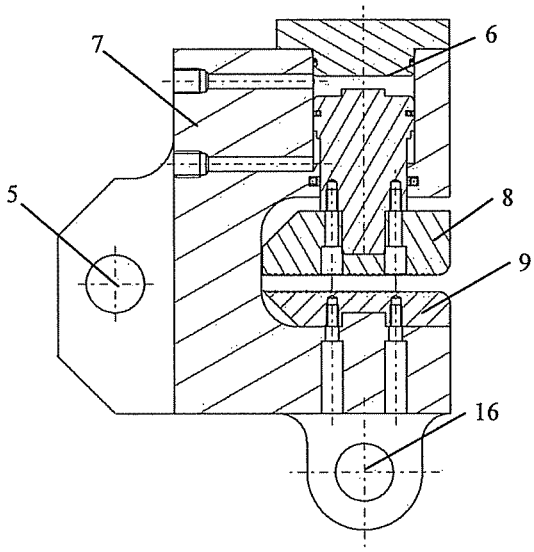
Figure 2C:
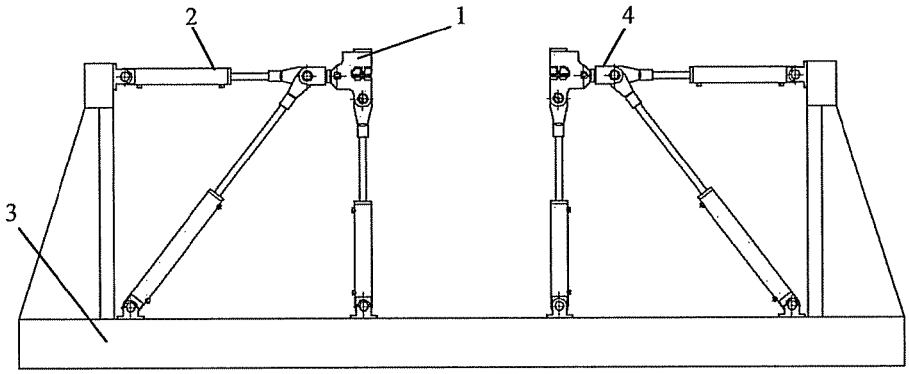
Figure 2D:
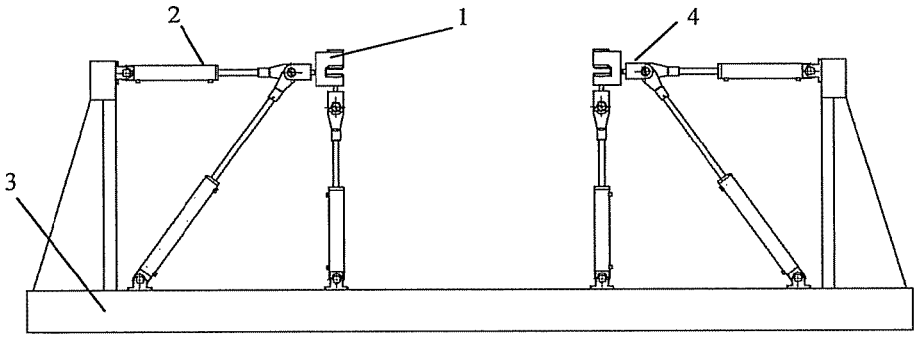
Figure 2E:
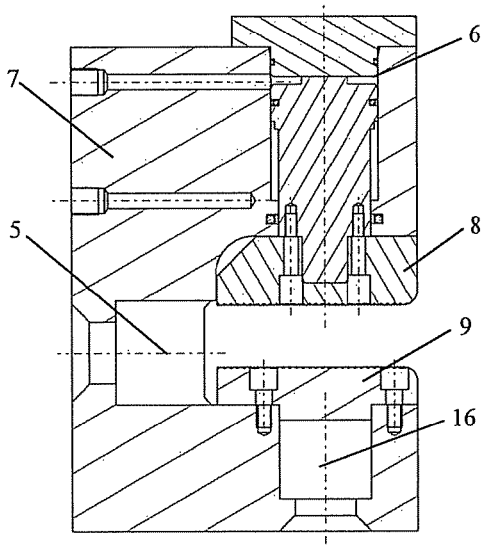

1—clamping mechanism; 2—stretching mechanism; 3—machine frame; 4—universal push-pull mechanism; 5—rear connecting hole of the clamping frame; 6—hydraulic clamping cylinder; 7—clamping frame; 8—clamper coupled with a piston; 9—clamper coupled with the clamping frame; 10—hydraulic cylinder type link; 11—hollow pivot shaft; 12—stretching link; 13—ball-headed linkage, having a half-ball-shaped head at one end; 14—clamping linkage; 15—solid pivot shaft; 16—lower connecting hole of the clamping frame; 17—bar-like link; 18—ring-like polyurethane pad; 19—bearing shoe having a half-ball-shaped recess; 20—circular polyurethane pad; 21—head retaining ring; 22—ball-headed linkage, having a complete-ball-shaped head at one end; 23—thrust bearing shoe having a half-ball-shaped recess; 24—length-adjustable bar-like link; 25—steel wire or flexible steel shaft; 26—retainer; 27—sheet material; 28—mold base; 29—solid mold; 30—multi-point adjustable digitalized mold; 31—pushing-down mechanism

DETAILED DESCRIPTION OF PREFERRED EMBODIMENTS

Now the structural details and the operation procedure of the invention will be described with reference to the embodiments shown in the drawings. Through out the drawings, elements having like or similar functions are represented by like reference numerals.

FIG. 1 includes a set of schematic views of a multi-clamp type stretch forming machine in which each clamping frame has a single connecting hole, wherein FIG. 1(*a*) is an isometric view, FIG. 1(*b*) is a front view, and FIG. 1(*c*) is a schematic enlarged sectional view of a clamping mechanism shown in FIGS. 1(*a*) and 1(*b*).

As shown in FIGS. 1(*a*) and 1(*b*), the multi-clamp type stretch forming machine mainly comprises clamping mechanisms 1, stretching mechanisms 2 and a machine frame 3. Each stretching mechanism 2 mainly comprises a hydraulic stretching cylinder and coupling members. However, it is contemplated that the stretching mechanism may be embodied as other mechanisms that can generate stretching force and displacement, such as any one of screw type drive mechanisms, rack and pinion mechanisms, cam and linkage mechanisms and the like. A row of ten clamping mechanisms 1 are disposed on each of opposite sides of the machine frame 3. It is noted that ten clamping mechanisms 1 are provided here only for illustrative purpose, and any other number of clamping mechanisms 1 can be provided in accordance with various stretch forming conditions.

As shown in FIG. 1(*c*), each clamping mechanism 1 comprises a clamping frame 7, clampers 8 and 9, and a hydraulic clamping cylinder 6. In this figure, the hydraulic clamping cylinder 6 of the clamping mechanism 1 forms an integral structure with the clamping frame 7. However, it is contemplated that the hydraulic clamping cylinder 6 of the clamping mechanism 1 and the clamping frame 7 may alternatively be formed as individual parts that are then combined together. In general, the hydraulic clamping cylinder 6 of the clamping mechanism 1 is a double-acting hydraulic cylinder with a short stroke. The clamper 8 is fixedly mounted to a piston of the hydraulic clamping cylinder 6 by screws, and the clamper 9 is fixedly mounted to the clamping frame 7 by screws. When the sheet material of a workpiece is to be clamped, a hydraulic fluid is fed into the hydraulic clamping cylinder via an upper port in the clamping frame 7 and is discharged out from the hydraulic clamping cylinder via a lower port in the clamping frame 7, so that the hydraulic clamping cylinder 6 of the clamping mechanism 1 drives the clamper 8, which is coupled with the piston, to move downwards and clamps the sheet material tightly with the clamper 9 which is coupled with the clamping frame 7. When the sheet material is to be released, the hydraulic fluid is fed via the lower port in the clamping frame 7 and discharged from the upper port, so that the hydraulic clamping cylinder 6 is controlled to drive the clamper 8, which is coupled with the piston, to move upwards away from the clamper 9 which is coupled with the clamping frame 7, and thus the sheet material is released.

In the embodiment shown in FIGS. 1(*a*), 1(*b*) and 1(*c*), the clamping frame 7 comprises a rear connecting hole 5. In this exemplary embodiment, as shown in FIG. 1(*b*), the clamping frame is coupled with three stretching mechanisms 2 simultaneously at the rear connecting hole 5 by means of a universal push-pull mechanism 4 which comprises mainly a ball-headed linkage and two pivot shafts, wherein the first stretching mechanism is disposed in a horizontal orientation, the second stretching mechanism is disposed in a vertical orientation, and the third stretching mechanism is disposed in an oblique orientation. Further, as an alternative option, the clamping frame may be coupled simultaneously with two stretching mechanisms 2 at the rear connecting hole 5 by means of a universal push-pull mechanism 4, wherein the first stretching mechanism is disposed in a horizontal orientation, while the second stretching mechanism is disposed in a vertical orientation or in an oblique orientation.

FIGS. 1(*d*) and 1(*e*) show schematic views of the universal push-pull mechanism 4, which comprises mainly a ball-headed linkage and two pivot shafts, as used in the embodiment shown in FIGS. 1(*a*) and 1(*b*). In the illustrated exemplary embodiment, the universal push-pull mechanism 4 comprises hydraulic cylinder type links 10, a hollow pivot shaft 11, a stretching link 12, a ball-headed linkage 13, a clamping linkage 14 and a solid pivot shaft 15. The stretching link 12 is coupled with three hydraulic cylinder type links 10 by means of the hollow pivot shaft 11. The ball-headed linkage 13 is coupled at one end with the stretching link 12 by means of a ball-shaped head, and coupled at the opposite end with the clamping linkage 14 by means of a screw type mechanism. The clamping linkage 14 is coupled with the clamping frame 7 of the clamping mechanism 1 by means of the solid pivot shaft 15. In this way, the clamping mechanism 1 is able to swing around the axis of the solid pivot shaft 15, and able to rotate around the axis of the ball-headed linkage 13 by means of the ball-headed linkage 13. When the sheet material is clamped tightly by the clamping mechanism 1 and is stretched in a certain stretching direction and stretching angle, the clamping mechanism 1 will swing and rotate to follow the shape of the curved surface of a stretch forming mold.

In the illustrated exemplary embodiment FIG. 1, the clamping frame is coupled at its rear connecting hole with one or more corresponding stretching mechanisms by means of a universal push-pull mechanism comprising mainly a ball-headed linkage and two pivot shafts. However, it is contemplated that, in all the exemplary embodiments of the invention, the clamping frame may be coupled at its rear connecting hole with one or more corresponding stretching mechanisms by means of a universal push-pull mechanism comprising a ball-headed linkage or a pivot shaft.

Of course, the number of the ball-headed linkage(s) and the number of the pivot shaft(s) used in the universal push-pull mechanism and the combination manner of them may be varied.

In an exemplary embodiment of the invention, the loading directions of the hydraulic stretching cylinders and the angles therebetween can be changed by changing the hydraulic forces and the strokes of the hydraulic stretching cylinders of the stretching mechanism 1, so that the position and the stretching direction of the clamping mechanism 1 are changed. In a stretch forming process, the position and the stretching direction of each clamping mechanism 1 are controlled by controlling the level of the hydraulic force and the stroke of the hydraulic stretching cylinder of the horizontal, vertical or oblique stretching mechanism, so that optimal stretching position and angle are established in the sheet material. In the illustrated exemplary embodiment, the stretching mechanism 2 and the clamping mechanism 1 are coupled by means of the universal push-pull mechanism 4, so that the clamping mechanism 1 may swing and rotate to follow the deforming tendency of the sheet material. Thus, the stretch forming machine has advantageously high flexibility.

In order to simplify the controlling system of the machine, a row of hydraulic cylinders disposed in the same orientation can be controlled by a single solenoid type reversing valve, by means of which, Pascal law in a multi-cylinder hydraulic system, process hardening characteristics of materials and law of minimum resistance are used advantageously, so that, under the action of a row of hydraulic cylinders having the same hydraulic force level, the clamping mechanisms 1 will move and rotate to follow the profile of the curved surface of the forming mold. As a result, the workpiece is likely to be affixed to the forming mold, and thus the material usage and the stretch forming quality of the workpiece can be increased.

FIG. 2 includes a set of schematic views of a multi-clamp type stretch forming machine in which each clamping frame has two connecting holes, wherein FIG. 2(*a*) is a front view showing a rear connecting hole 5 and a lower connecting hole 16 of the clamping frame 7, each connecting hole being coupled with one or more corresponding stretching mechanisms 2 by means of a universal push-pull mechanism 4 comprising mainly a ball-headed linkage and two pivot shafts. The exemplary embodiment shown in FIG. 2(*a*) has a basic structure and operation procedure similar to that of the exemplary embodiment shown in FIGS. 1(*a*), 1(*b*) and 1(*c*). Only the differences between them will be described for simplicity.

As shown in FIG. 2(*b*), in this exemplary embodiment, each clamping frame 7 is provided with a rear connecting hole 5 and a lower connecting hole 16. The clamping frame 7 is coupled, at the rear connecting hole 5, simultaneously with two stretching mechanisms 2 respectively by means of a universal push-pull mechanism 4 comprising mainly a ball-headed linkage and two pivot shafts, wherein the first stretching mechanism is disposed in a horizontal orientation, and the second stretching mechanism is disposed in an oblique orientation. The clamping frame 7 is also coupled, at the lower connecting hole 16, with a stretching mechanism 2 disposed in a vertical direction by means of a universal push-pull mechanism 4 comprising mainly a ball-headed linkage and two pivot shafts.

In the exemplary embodiment of the invention, the stretching mechanisms coupled with the clamping frame at the rear connecting hole 5 are adapted to apply a stretching force and to control the stretching direction, and the stretching mechanism coupled with the clamping frame at the lower connecting hole 16 is adapted to finely adjust the stretching direction. The stretching force and the stretching direction of the clamping mechanism 1 can be adjusted by adjusting the hydraulic force levels of the hydraulic stretching cylinders of stretching mechanisms disposed in different directions. As described above, it is contemplated that, in the exemplary embodiments, the universal push-pull mechanism for coupling the clamping frame 7 and the stretching mechanism 2 may be in the form of either a universal push-pull mechanism 4 composed of a ball-headed linkage or a universal push-pull mechanism 4 composed of a pivot shaft, only if the same stretching effect can be obtained. Of course, the number of the ball-headed linkage(s) and the number of the pivot shaft(s) used in the universal push-pull mechanism and the combination manner of them may be varied.

As shown in FIG. 2(*c*), the clamping frame 7 is coupled at the lower connecting hole 16 with a stretching mechanism 2, which is disposed in a vertical direction, by means of a universal push-pull mechanism 4 comprising a pivot shaft. Further, the clamping frame 7 is coupled at the rear connecting hole 5 with two stretching mechanisms 2 by means of a universal push-pull mechanism 4 which comprises mainly a ball-headed linkage and two pivot shafts, wherein the first stretching mechanism is disposed in a horizontal orientation, and the second stretching mechanism is disposed in an oblique orientation. The basic structure and the operation procedure of the clamping mechanism 1 shown in FIG. 2(*c*) are similar to that of the exemplary embodiment shown in FIG. 2(*b*).

It is noted that, in the exemplary embodiments of the invention, by using the universal push-pull mechanism 4, the degree of freedom of each clamping mechanism is significantly increased because the clamping mechanism is able to rotate and swing in a free way around the ball-shaped head of the ball-headed linkage of the universal push-pull mechanism 4, so that a row of multiple clamping mechanisms 1 can be aligned in a straight or curve line. Flexible control of a plurality of clamping mechanisms can also be achieved, so that the workpiece is more liable to be affixed to the forming mold in a stretch forming process, the material usage of the workpiece is significantly increased, and better workpiece forming effect can be obtained.

the universal push-pull mechanisms 4 used in the schematic view of FIG. 2 are described here only for illustrative purpose, the universal push-pull mechanism 4 comprising mainly a ball-headed linkage and two pivot shafts and the universal push-pull mechanism 4 comprising mainly a ball-headed linkage or a pivot shaft may alternatively be constructed in other forms different from that described here, only if the purpose of increasing the degree of freedom of the clamping mechanism can be increased.

As shown in FIG. 2(*d*), the clamping frame 7 is coupled at its rear connecting hole 5 and lower connecting hole 16 with stretching mechanisms by means of universal push-pull mechanisms each comprising mainly a ball-headed linkage and a pivot shaft.

FIG. 2(*e*) is an enlarged sectional view of a clamping mechanism shown in FIG. 2(*d*). The clamping frame 7 is coupled at the rear connecting hole 5 with two stretching mechanisms 2 by means of a universal push-pull mechanism 4 which comprises mainly a ball-headed linkage and a pivot shaft, wherein the first stretching mechanism is disposed in a horizontal orientation, and the second stretching mechanism is disposed in an oblique orientation. The clamping frame is also coupled at the lower connecting hole 16 with a stretching mechanism, which is disposed in a vertical direction, by means of a universal push-pull mechanism 4 which comprises mainly a ball-headed linkage and a pivot shaft.

it is contemplated that, in the exemplary embodiments, the clamping frame can be coupled at the rear connecting hole 5 with a stretching mechanism, which disposed in a horizontal direction, by means of a universal push-pull mechanism, or coupled simultaneously with any combination of stretching mechanisms disposed in a horizontal direction, in an oblique orientation and in a vertical direction, only if the same stretching effect can be obtained.

Figure 3A:
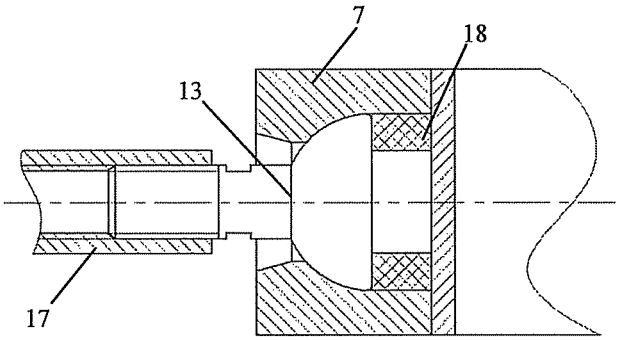
Figure 3B:
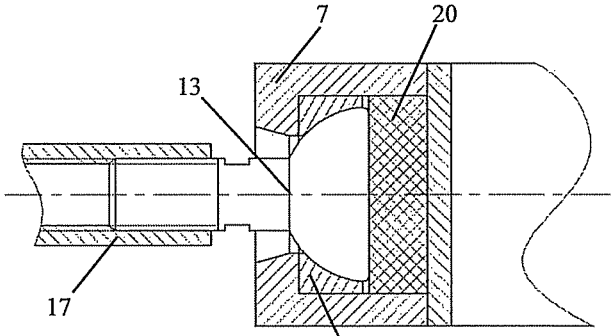
Figure 3C:
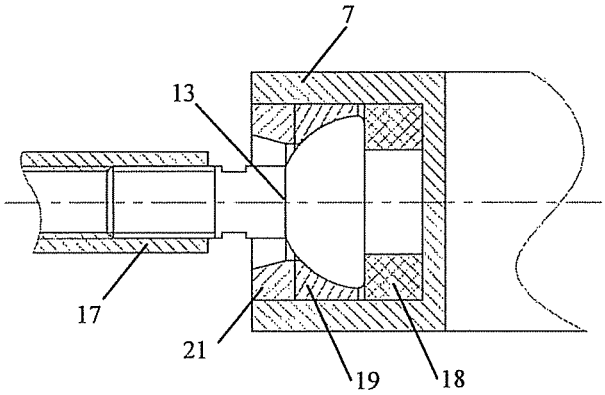
Figure 4:
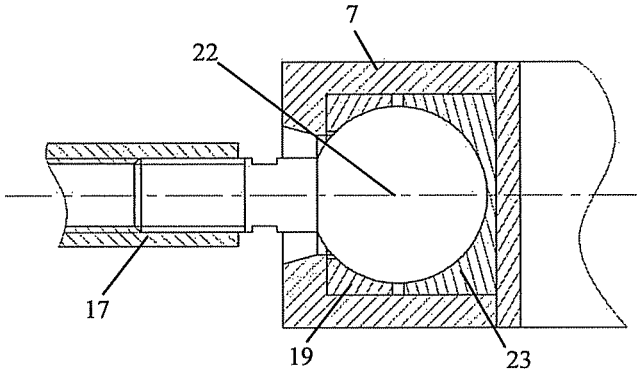
FIG. 4 is a sectional view of a ball-headed linkage, having a complete-ball-shaped head at one end, mounted in a connecting hole of the clamping frame.

FIGS. 3 and 4 show, only for illustrative purpose, illustrative optional embodiments of clamping mechanisms coupled by means of universal push-pull mechanisms each mainly comprises a ball-headed linkage, a link and the like. FIG. 3(*a*) is a sectional view of a ball-headed linkage 13, having a half-ball-shaped head at one end, mounted directly in a connecting hole of the clamping frame 7. A ring-like polyurethane pad 18 is provided at a half-ball-shaped end of the ball-headed linkage 13. It is practical to adjust the level of the elastic returning force of the ring-like polyurethane pad by varying the inner and outer diameters and the thickness of the ring-like polyurethane pad. Alternatively, the ring-like polyurethane pad 18 having a lower elastic returning force can be substituted by a circular polyurethane pad 20 having a higher elastic returning force according to real need.

The opposite end of the ball-headed linkage 13 or 22 (with reference to FIG. 4), which does not have a ball-shaped head, can be coupled with the stretching mechanism 2 by means of a screw type mechanisms and a bar-like link 17. Of course, other coupling manners such as snap lock can also be used.

FIG. 3(*b*) is a sectional view of a ball-headed linkage 13, having a half-ball-shaped head at one end, mounted in a connecting hole of the clamping frame 7 by means of a bearing shoe 19 having a half-ball-shaped recess. The material for forming the bearing shoe 19 may be a bearing material such as copper or Nylon. A circular polyurethane pad 20 can be provided at a half-ball-shaped end. It is practical to adjust the level of the elastic returning force of the circular polyurethane pad 20 by adjusting the diameter and the thickness of it. Alternatively, the circular polyurethane pad 20 having a higher elastic returning force can be substituted by a ring-like polyurethane pad 18 having a lower elastic returning force according to real need.

FIG. 3(*c*) is a sectional view of a ball-headed linkage 13, having a half-ball-shaped head at one end, mounted in a connecting hole of the clamping frame 7 by means of a bearing shoe 19 having a half-ball-shaped recess and a head retaining ring 21. For facilitating the swing and rotation of the ball-shaped head, a lubricant may be applied between an inner retention portion of the half-ball-shaped head and the bearing shoe 19 for lubrication.

FIG. 4 is a sectional view of a ball-headed linkage 22, having a complete-ball-shaped head at one end, mounted in a connecting hole of the clamping frame 7. An inner retention portion of the ball-shaped head is equipped with a bearing shoe 19 having a half-ball-shaped recess, and an outer free end of the complete-ball-shaped head is equipped with a thrust bearing shoe 23 having another half-ball-shaped recess. For facilitating the swing and rotation of the ball-shaped head, a lubricant may be applied between the ball-shaped head and the bearing shoe for lubrication.

Figure 5:
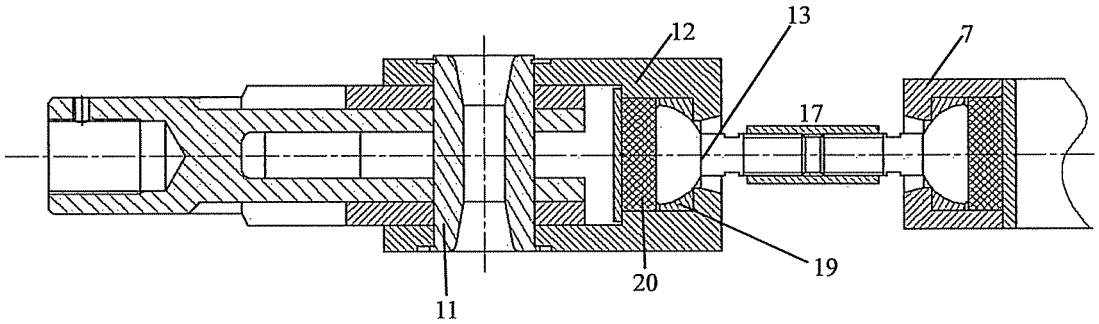
FIG. 5 is a sectional view showing an embodiment in which two ball-headed linkages, each having a half-ball-shaped head at one end, are adopted.

FIG. 5 is a sectional view showing an embodiment in which two ball-headed linkages 13, each having a half-ball-shaped head at one end, are adopted. The two half-ball-shaped heads each has an inner retention portion equipped with a bearing shoe 19 which defines a half-ball-shaped recess, and an outer free end equipped with a circular polyurethane pad 20. For facilitating the swing and rotation of the ball-shaped head, a lubricant may be applied between an inner retention portion of the half-ball-shaped head and the bearing shoe 19 for lubrication. The two ball-headed linkages each has an opposite end which does not have a ball-shaped head and is coupled with a common bar-like link 17 by means of a screw type mechanism. In this figure, the ball-headed linkage on the right side of the bar-like link 17 is coupled with the clamping frame 7, and the ball-headed linkage on the left side is coupled with two stretching mechanisms 2.

Figure 6:
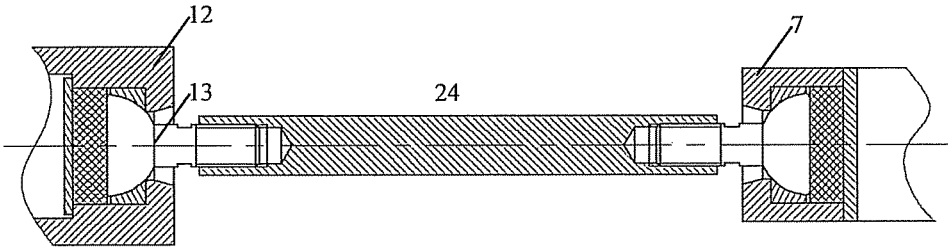
FIG. 6 is a sectional view showing an embodiment in which two ball-headed linkages, each having a half-ball-shaped head, are adopted in combination with a length-adjustable bar-like link.
Figure 7A:
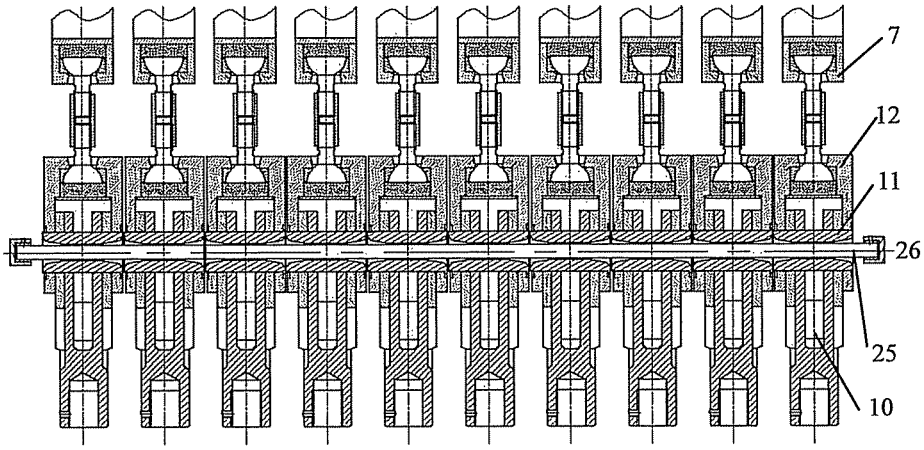
Figure 7B:
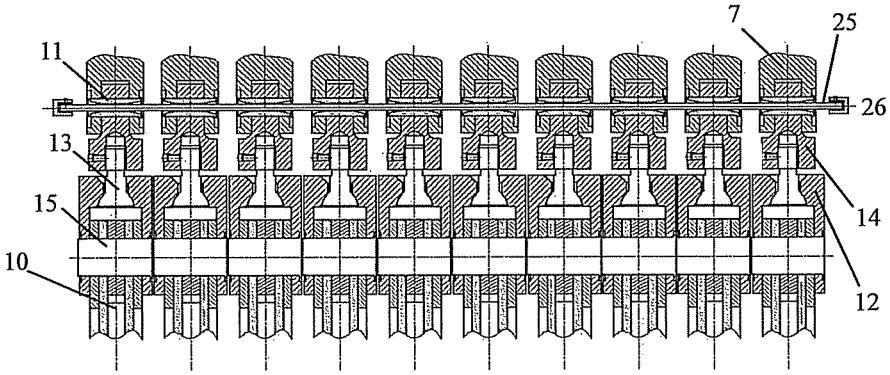
Figure 7C:
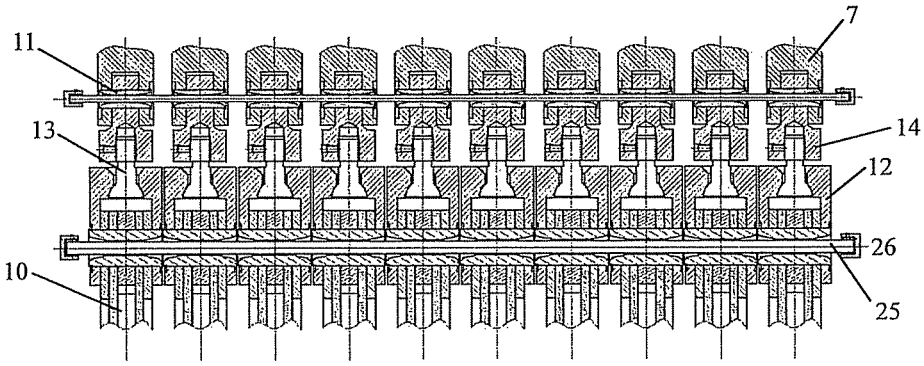
Figure 7D:
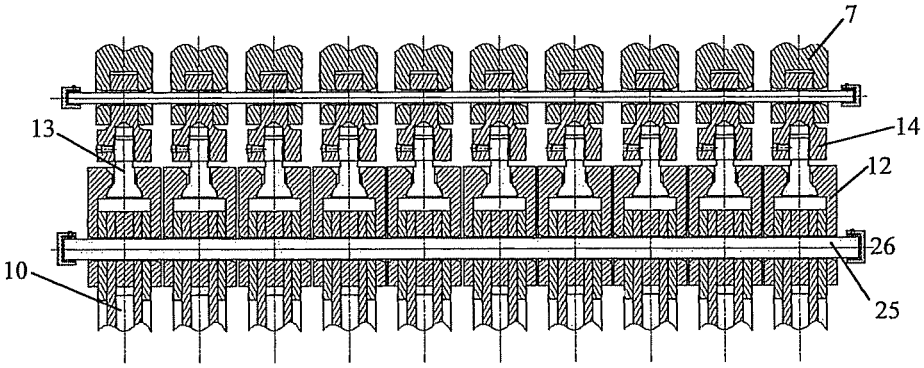

FIG. 6 is a sectional view showing an embodiment in which two ball-headed linkages 13, each having a half-ball-shaped head, are adopted in combination with a length-adjustable bar-like link 24. The length-adjustable bar-like link 24 is coupled between the two ball-headed linkage 13 by means of screw type mechanisms. When a workpiece having a smaller length is to be stretch formed but the stroke of the hydraulic stretching cylinders of the stretch forming machine is not long enough, the length of a universal push-pull mechanism, which comprises mainly two ball-headed linkages or the like, can be adjusted by means of the length-adjustable bar-like link, which results in smaller non-processed margin area of workpiece, and various production requirements of multi-type workpiece can be met. It is contemplated that the length-adjustable bar-like link 24 can be coupled with the ball-headed linkage 13 by any suitable connection manners, such as snap lock type and bolt type connections. For this end, when a universal push-pull mechanism 4 which comprises mainly a ball-headed linkage and a pivot shaft is adopted (see for example FIG. 1e), the length-adjustable bar-like link 24 can be coupled between the ball-headed linkage 13 and the clamping linkage 14 by means of a screw type mechanism or other mechanisms. In addition, linkages such as the ball-headed linkage 13 and the clamping linkage 14 can also have adjustable lengths to account for the above condition.

A ring-like or circular polyurethane pad is adopted in the exemplary embodiments shown in FIGS. 3 to 6. The purpose of adopting a polyurethane pad is that, after the stretch forming, the ball-headed linkage can automatically return to its original position under the elastic returning force provided by the polyurethane pad. Thus, in the technical solutions of the invention, the polyurethane pad can be substituted by an elastic pad made of any other elastic material, or substituted by a spring.

FIG. 7 includes a set of sectional views showing clamping frames and stretching mechanisms coupled by means of universal push-pull mechanisms which comprise different combinations of pivot shafts, a steel wire, a flexible steel shaft or similar elements. First, FIG. 7(*a*) is a sectional view showing an embodiment in which stretching links and hydraulic cylinder type links are coupled by means of a plurality of hollow pivot shafts through which a steel wire or flexible steel shaft is inserted. A first end of each stretching link 12 is coupled with a corresponding clamping frame 7 by means of two ball-headed linkages 13 each having a half-ball-shaped head at one end, and a second end of the stretching link 12 is coupled with two hydraulic cylinder type links 10 by means of a hollow pivot shaft 11 through which a common steel wire or flexible steel shaft 25 is inserted. Opposite ends of the steel wire or flexible steel shaft 25 are each fixed with a retainer 26 by a screw, for restricting the axial displacement of the common steel wire or flexible steel shaft. By providing the common steel wire or flexible steel shaft, the universal push-pull mechanisms, each comprising mainly of two ball-headed linkages and a pivot shaft, and the clamping mechanisms can be displaced in a substantially synchronized manner. The steel wire or flexible steel shaft has an outer diameter which is smaller than the inner diameter of the hollow pivot shaft, so that a row of universal push-pull mechanisms, each comprising mainly two ball-headed linkages and a pivot shaft, can be aligned along a curve line.

It is contemplated that the configuration of the steel wire or flexible steel shaft can be different from that shown in FIG. 7(*a*), only if the universal push-pull mechanisms and their corresponding clamping mechanisms are displaced in a substantially synchronized manner. As an example, FIG. 7(*b*) is a sectional view showing an embodiment in which stretching links and hydraulic cylinder type links are coupled by means of a plurality of solid pivot shafts, and clamping frames and clamping linkages are coupled by means of a plurality of hollow pivot shafts through which a steel wire or flexible steel shaft is inserted. Each clamping linkage 14 is coupled with the clamping frame 7 of a corresponding clamping mechanism by means of a hollow pivot shaft 11, and each stretching link 12 is coupled with three hydraulic cylinder type links 10 by means of a solid pivot shaft 15. In this embodiment, a common steel wire or flexible steel shaft 25 is inserted through the hollow pivot shafts 11, and opposite ends of the steel wire or flexible steel shaft 25 are each fixed with a retainer 26 by a screw, for restricting the axial displacement of the common steel wire or flexible steel shaft.

FIG. 7(*c*) is a sectional view showing an embodiment in which stretching links and hydraulic cylinder type links are coupled and clamping frames and clamping linkages are coupled respectively by means of a plurality of hollow pivot shaft through which a steel wire or flexible steel shaft is inserted. Each clamping linkage 14 is coupled with the clamping frame 7 of a corresponding clamping mechanism by means of a hollow pivot shaft 11, and each stretching link 12 is coupled with three hydraulic cylinder type links 10 by means of another hollow pivot shaft 11.

It is noted that the above embodiments are given only for illustrative, not restrictive, purpose. For example, in the technical solutions of the invention, the universal push-pull mechanism may be formed directly by several steel wire or flexible steel shafts 25. FIG. 7(*d*) is a sectional view showing an embodiment in which stretching links and hydraulic cylinder type links are coupled and clamping frames and clamping linkages are coupled respectively by means of a steel wire or flexible steel shaft 25 directly. Each clamping linkage 14 is coupled with the clamping frame 7 of a corresponding clamping mechanism by means of a common steel wire or flexible steel shaft 25, and each stretching link 12 is coupled with three hydraulic cylinder type links 10 by means of another common steel wire or flexible steel shaft 25.

Figure 8:
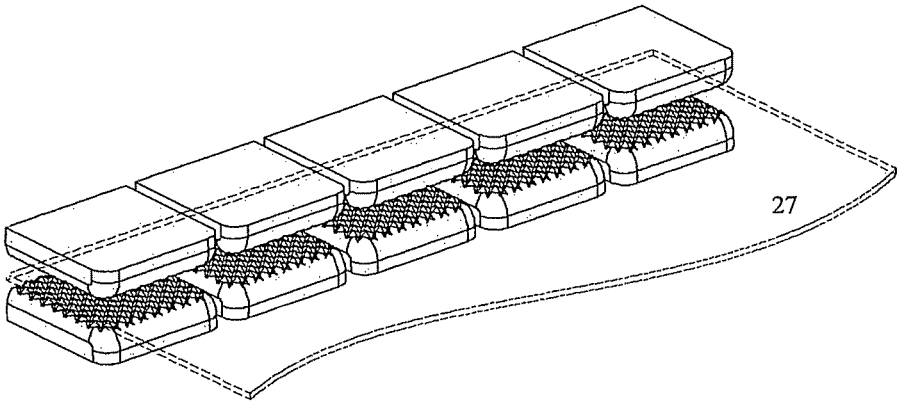
FIG. 8 is a schematic view showing an embodiment in which multiple pairs of biting dampers are adopted.

FIG. 8 is a schematic view showing an embodiment in which multiple pairs of biting dampers are adopted. In this exemplary embodiment, right and left sides of the stretch forming machine are each provided with a row of five pairs of biting dampers.

There is a gap between neighboring dampers. The clamper comprises a clamping surface, a front edge and two front corners of which are rounded with relatively large radii. Right and left edges of the clamping surface, which are adjacent to neighboring clampers, are also be rounded with a certain radius. In this way, the sheet material of a workpiece is allowed to be displaced or expended at locations corresponding to the gaps and the rounded portions. The clamping surface is of biting type by providing many biting protrusions, so that the sheet material can be clamped tightly between each pair of clampers. Thus, during the stretch forming process, the sheet material is not allowed to move in the biting areas of the clampers.

Figure 9A:
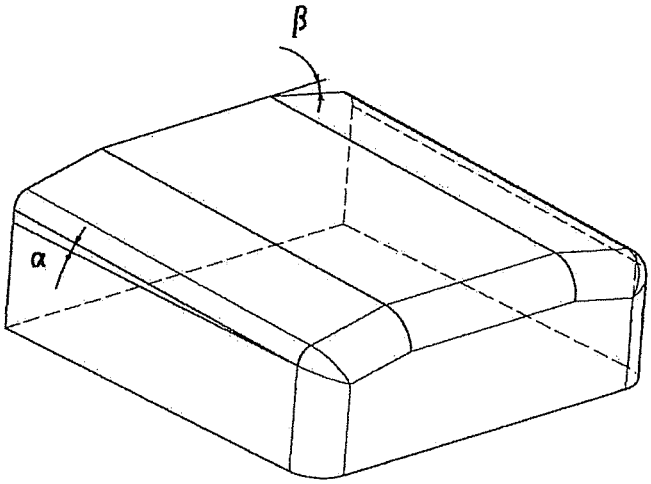
Figure 9B:
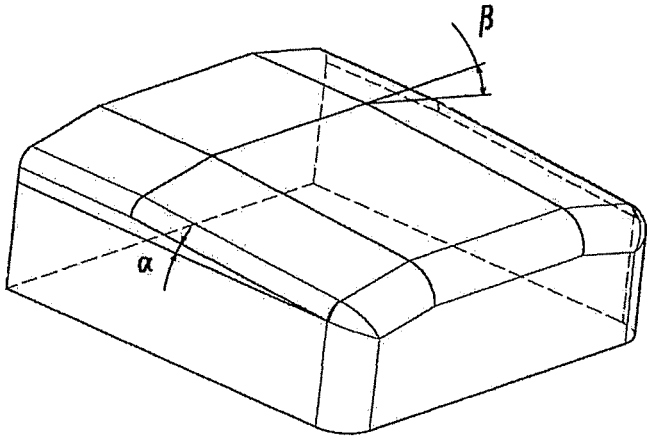

FIG. 9 includes a set of schematic views of clampers with slanted clamping surfaces, wherein FIG. 9(*a*) is a schematic view of a damper having a height gradually reduced from its back end to its front end; and FIG. 9(*b*) is a schematic view of a clamper having a horizontal segment and a tapered segment from its back end to its front end. The clamping surface of the clamper shown in FIG. 9(*a*) and FIG. 9(*b*) is higher in its middle portion and is tapered gradually towards its left and right sides. The taper angle $\alpha$ of the clamper from its back end to its front end is preferably smaller than the taper angle $\beta$ from the middle portion of the clamping surface to the right and left sides. In the thicker areas of the clampers, the sheet material is clamped by the clamps tightly by maximum clamping forces, and thus no displacement of the sheet material is allowed. On the other hand, in the tapered areas of the clampers, the clamping forces are decreased gradually, so that a certain degree of displacement and expansion of the sheet material are allowed.

Figure 10A:
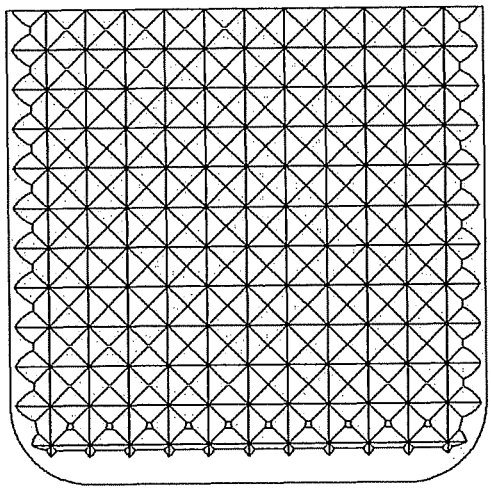
Figure 10B:
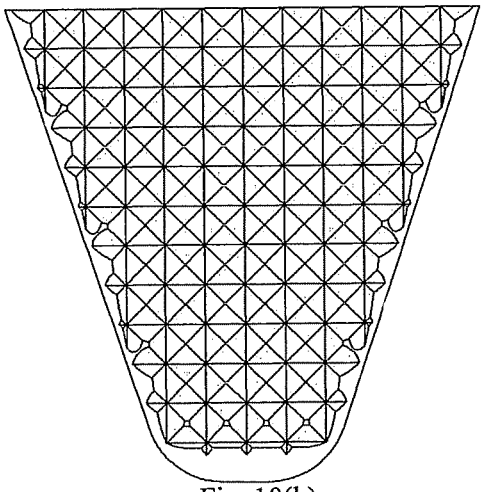
Figure 10C:
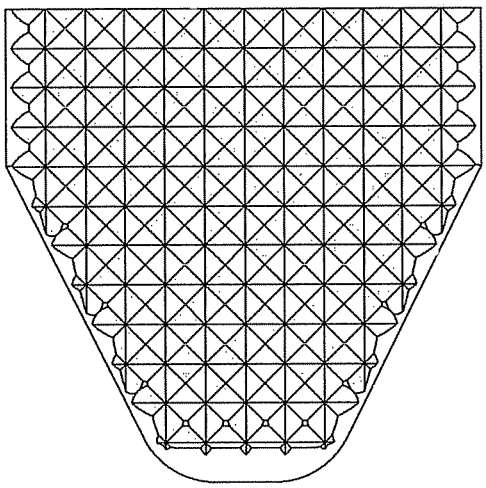

FIG. 10 includes a set of schematic views of clampers of different shapes, wherein FIG. 10(*a*) is a schematic view of a rectangular clamper; FIG. 10(*b*) is a schematic view of a trapezoidal clamper; and FIG. 10(*c*) is a schematic view of a six-sided damper having a profile formed by combination of a rectangle and a trapezoid. By using clampers of different shapes, and by rounding two corners of the clamping surface with larger radius, the clamping surface is formed with a front side length which is equal to or less than the back side length of the clamping surface, which helps the displacement and expansion of the sheet material with larger gradients occur in the area near the clamping surface, so that the stretch forming of a workpiece with a large transverse curvature or having transverse wave shape can be performed, and various production requirements of multi-type workpiece can be met.

Figure 11:
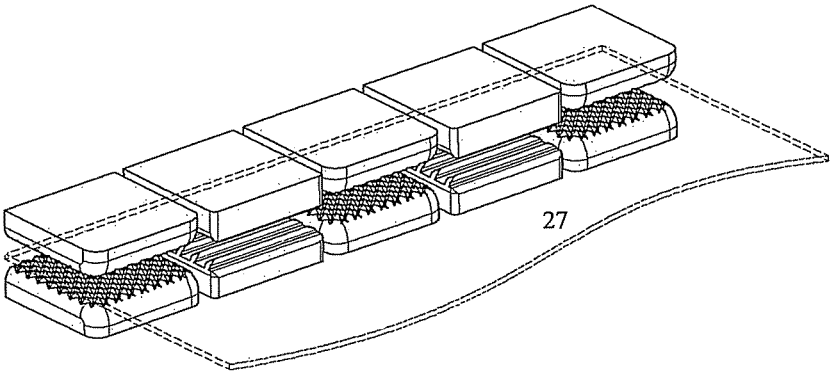
FIG. 11 is a schematic view showing an embodiment in which biting clampers are used in combination with sliding-through clampers.

FIG. 11 is a schematic view showing an embodiment in which biting clampers are used in combination with sliding-through clampers. The biting clampers which have many biting protrusions on their clamping surfaces and the sliding-through clampers which have several drawing ribs on their clamping surfaces can be alternately disposed one by one or set by set, so that displacement and expansion with larger gradients can occur in the sheet material. As a result, the clamping mechanisms can be aligned along a curve line or a wave line to follow the profile of the forming mold, and flexible control of a plurality of clampers of a stretch forming machine can be achieved.

Figure 12:
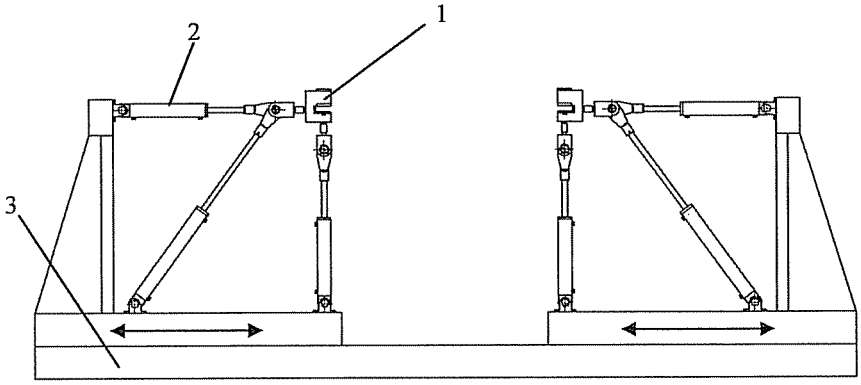
FIG. 12 is a schematic view of a multi-clamp type stretch forming machine in which the distance between right side clamping mechanisms and stretching mechanisms and left side clamping mechanisms and stretching mechanisms is adjustable.

FIG. 12 is a schematic view of a multi-clamp type stretch forming machine in which the distance between right side clamping mechanism 1 and stretching mechanism 2 and left side clamping mechanism 1 and stretching mechanism 2 is adjustable. When the workpieces have significantly different lengths, the distance between a plurality of clamping mechanism 1 and stretching mechanisms 2 on the left side of the machine frame and a plurality of clamping mechanism 1 and stretching mechanisms 2 on the right side of the machine frame can be adjusted according to the lengths of different workpieces. Once the distance between the left and right clamping mechanisms 1 of the multi-clamp type stretch forming machine is adjusted, a support of each set of stretching mechanisms can be locked by means of a self-lock mechanism which comprise a hydraulic cylinder or a fastener. For simplifying the structure of the machine, it is practical that only a plurality of clamping mechanisms 1 and stretching mechanisms 2 on one of left and right side of the machine frame are moveable. Further, for increasing the transverse width of a stretch forming machine, it is practical to increase the number of the clamping mechanisms 1 and the stretching mechanisms 2, or to combine two stretch forming machines side by side.

Figure 13:
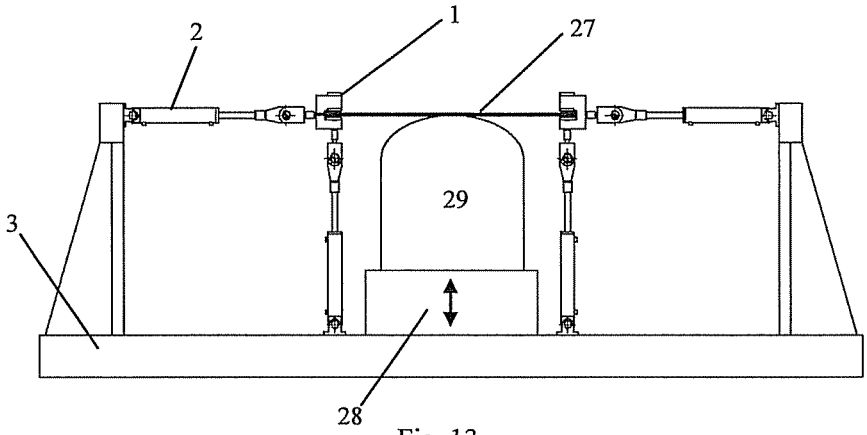
FIG. 13 is a schematic view showing an embodiment in which a mold base, being movable up and down, is used cooperatively with a solid mold in a stretch forming process.

FIG. 13 is a schematic view showing an embodiment in which a mold base 28, being movable up and down, is used cooperatively with a solid mold 29 in a stretch forming process. When the mold base is movable up and down, the obliquely disposed stretching mechanisms can be omitted, which further simplifies the structure of the invention stretch forming machine. In a stretch forming process, a sheet material 27 can be pre-stretched by a pulling force by a row of hydraulic stretching cylinders. Then, by moving the mold base upwards, the vertically disposed hydraulic stretching cylinders force the sheet material 27 to be affixed to the mold gradually, so that the sheet material 27 is stretch formed. When molds of different shapes are used, the stretch forming of the sheet material can be achieved by controlling the strokes of the hydraulic cylinders.

Figure 14:
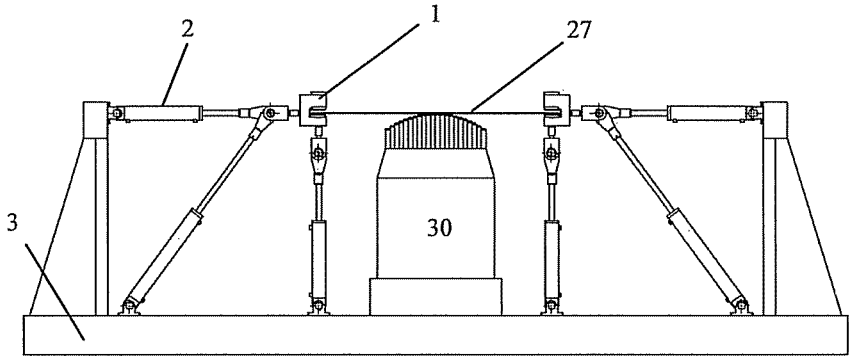
FIG. 14 is a schematic view showing an embodiment in which a multi-point adjustable digitalized mold is used in a stretch forming process.

FIG. 14 is a schematic view showing an embodiment in which a multi-point adjustable digitalized mold 30 is used in a stretch forming process. By using the multi-point adjustable digitalized mold 30, the molding surface of the mold can be varied at will, and various production requirements of multi-type workpiece can be met.

Figure 15:
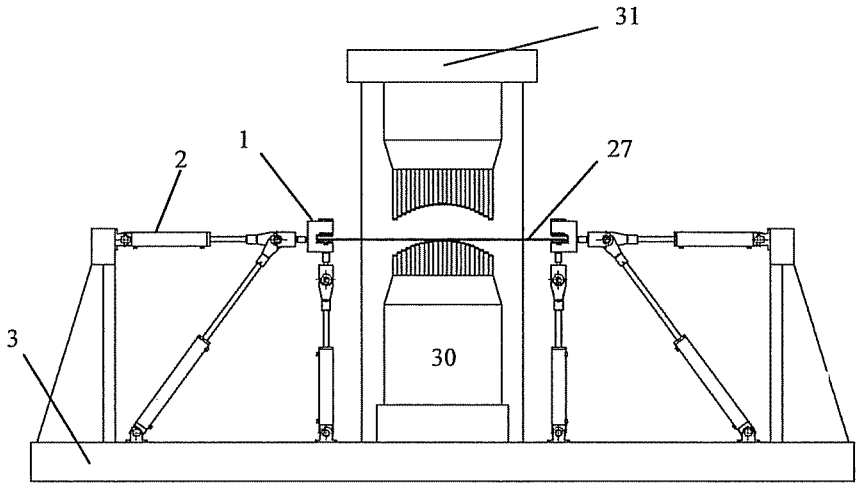
FIG. 15 is a schematic view showing an embodiment in which a pushing-down mechanism is used in a stretch forming process.

FIG. 15 is a schematic view showing an embodiment in which a pushing-down mechanism 31 is used in a stretch forming process. The pushing-down mechanism 31, in cooperation with the clamping mechanism 1 and multi-point adjustable digitalized mold 30, applies a pressure to the sheet material 27, so that the sheet material 27 will be affixed to the mold in a better way, and wave-shaped workpieces or workpieces of complex shapes can be stretch formed.

An exemplary operation process of the multi-clamp type stretch forming machine of the invention will be described now. First, on the basis of the size and dimensions of a workpiece, the number of the clamping mechanisms 1 and the original positions of the stretching mechanisms 2 and the clamping mechanisms 1 are determined, and the shapes of the clampers are selected. Then, by adjusting the strokes of the hydraulic cylinders of the stretching mechanisms 2 disposed in different directions, the positions of a plurality of clampers are set. Then, a sheet material is inserted at its opposite edges into receiving gaps of the clampers of the clamping mechanisms 1, and the sheet material is clamped tightly by means of the clamping mechanisms 1. After the sheet material is clamped, the sheet material is pre-stretched by adjusting the strokes of the hydraulic cylinders of the horizontally disposed stretching mechanism 2. Then in a stretch step, the strokes and hydraulic forces of the hydraulic cylinders of a row of stretching mechanism 2 disposed in different directions, as a whole, are adjusted, or the upward pressure applied by the mold base 28 or the downward pressure applied by pushing-down mechanism 31 to the sheet material 27 is adjusted, so that the stretching force and the stretching direction of the clamping mechanism 1 are controlled. As a result, the clamping mechanisms 1 move and rotate to follow the curvature of the molding surface, and thus the workpiece is affixed to the mold. For increasing the mold affixing ability of the workpiece, the sequence of the movements of the vertically, horizontally and obliquely disposed stretching mechanisms 2, the upward movement of the mold base 27, the downward movement of the pushing-down mechanism 31 and the like can be adjusted. After stretch forming, the sheet material is released from the clampers by adjusting the strokes of the hydraulic cylinders of the clamping mechanisms 1.

According to the multi-clamp type stretch forming machine of the invention, each clamping mechanism is provided with one or two connecting holes where the clamping mechanism is coupled with one or more stretching mechanisms by means of a universal push-pull mechanism. Further, the Pascal law in a multi-cylinder hydraulic system, process hardening characteristics of materials and law of minimum resistance are used in the invention, so that, under the same level of hydraulic force of a row of hydraulic cylinders, a plurality of clamping mechanisms can move and rotate to follow the curvature of a molding surface. In this way, the load applying pattern on the workpiece is optimized, and the stretch stress and the stretch strain in the workpiece are distributed more uniformly. The mold affixing ability of the workpiece is increased, the non-processed margin area of a stretch formed piece is decreased, and the material usage and the forming quality are increased. The multi-clamp type stretch forming machine provides flexible control to a plurality of clampers by using a simple and cost efficient hydraulic system, so that the workpiece forming effect is improved compared with traditional stretch forming machines.

The embodiments of the invention as described above are illustrative, not restrictive. The features of the above embodiments can be changed, combined or modified in any suitable manners within the scope and spirit of the invention, and the scope of protection of the invention is intended to cover all these changes, combinations and modifications.

The invention claimed is:

1. A multi-clamp type stretch forming machine, comprising:

clamping mechanisms, each clamping mechanism comprising a clamping frame provided with a rear connecting hole and a lower connecting hole, a clamper, and a hydraulic clamping cylinder;

stretching mechanisms; and a machine frame;

wherein a row of multiple clamping mechanisms are aligned on each of opposite sides of the machine frame; and wherein the lower connecting hole is coupled with a vertically disposed stretching mechanism by a universal push-pull mechanism, and the rear connecting hole is coupled with a horizontally disposed stretching mechanism by another universal push-pull mechanism or coupled simultaneously with a set of stretching mechanisms by another universal push-pull mechanism, the set of stretching mechanisms comprising any combination of a horizontally disposed stretching mechanism, an obliquely disposed stretching mechanism, and a vertically disposed stretching mechanism.

2. The multi-clamp type stretch forming machine of claim 1, wherein each of the stretching mechanisms comprises a hydraulic stretching cylinder, and wherein a row of hydraulic stretching cylinders aligned in a same direction are controlled by one or more solenoid type reversing valves.

3. The multi-clamp type stretch forming machine of claim 1, wherein each of the universal push-pull mechanisms comprises one of a ball-headed linkage, a pivot shaft, and a combination of a ball-headed linkage, a pivot shaft and a link; and wherein one end of the ball-headed linkage forms a ball-shaped head, the ball-shaped head being mounted in the clamping frame or in a stretching link, directly or by a bearing shoe having a half-ball-shaped recess which is fit with a ball-shaped surface of a retention portion of the ball-shaped head; and wherein an opposite end of the ball-headed linkage is coupled with a corresponding link by a screw type mechanism or a pivot shaft.

4. The multi-clamp type stretch forming machine of claim 3, wherein the ball-shaped head comprises a half-ball shape or a complete-ball shape; and wherein when the ball-shaped head is configured with the half-ball shape, an elastic pad, such as a polyurethane pad, is provided at the ball-shaped head; and wherein when the ball-shaped head is configured with the complete-ball shape, a thrust bearing shoe having a half-ball-shaped recess is provided at the ball-shaped head.

5. The multi-clamp type stretch forming machine of claim 3, wherein the ball-headed linkage comprises two ball-headed linkages which are coupled with each other symmetrically by a bar-like link, such that a universal push-pull mechanism comprising dual ball-shaped heads is formed.

6. The multi-clamp type stretch forming machine of claim 5, wherein a length of the universal push-pull mechanism is adjustable by a length-adjustable bar-like link.

7. The multi-clamp type stretch forming machine of claim 3, wherein the pivot shaft comprises a solid pivot shaft or a hollow pivot shaft; and wherein when the pivot shaft is configured as the hollow pivot shaft, one or more steel wires or flexible steel shafts are inserted through a row of the hollow pivot shafts.

8. The multi-clamp type stretch forming machine of claim 3, wherein all of the pivot shafts, as a whole, are substituted by one or more steel wires or flexible steel shafts inserted through the clamping mechanisms.

9. The multi-clamp type stretch forming machine of claim 1, wherein each of the clamping mechanisms in a row of multiple clamping mechanisms disposed on either side of the machine frame comprises a pair of clampers such that a gap is formed between neighboring clampers, and wherein each of the clampers comprises a clamping surface, a front edge, and two front corners which are rounded with relatively large radii, and wherein right and left edges of the clamping surface, which are adjacent to the other clampers, are also rounded.

10. The multi-clamp type stretch forming machine of claim 1, wherein a clamping surface of the clamper comprises:

a horizontal surface; or a back end slightly higher than its front end; or a back end which is a horizontal surface and is slightly higher than a front end of the clamping surface; or a middle portion which is slightly higher than its left and right ends which are adjacent to other clampers and tapered gradually.

11. The multi-clamp type stretch forming machine of claim 1, wherein the clamper comprises a rectangular shape, a trapezoidal shape, or a six-sided shape which is composed of a rectangle and a trapezoid; and a length of a front side of a clamping surface of the clamper is equal to or less than a length of a back side of the clamping surface.

12. The multi-clamp type stretch forming machine of claim 1, wherein each of the clampers comprises a biting clamper which has a clamping surface formed with a plurality of biting protrusions, or a sliding-through clamper which has a clamping surface formed with a plurality of drawing ribs; and wherein the biting clampers and the sliding-through clampers are used in a mixed manner in a row of multiple clamping mechanisms.

13. The multi-clamp type stretch forming machine of claim 1, wherein a distance between the clamping mechanisms and the stretching mechanisms on a left side of the machine frame, and the clamping mechanisms and the stretching mechanisms on a right side of the machine frame is adjustable; and/or a forming mold used with the stretch forming machine comprises a solid mold or a multi-point adjustable digitalized mold, the forming mold having a mold base which is movable upwards; and/or a pushing-down mechanism is mounted to an upper portion of the stretch forming machine.

* * * * *